United States Patent [19]

Hafstrom

[11] 4,022,147

[45] May 10, 1977

[54] FLYWHEEL IMPELLED CYCLE SIGNAL FOR APPLIANCE

[75] Inventor: Warren Richard Hafstrom, Stevensville, Mich.

[73] Assignee: Whirlpool Corporation, Benton Harbor, Mich.

[22] Filed: Oct. 22, 1975

[21] Appl. No.: 624,716

[52] U.S. Cl. ..... 116/67 R; 34/89; 116/74

[51] Int. Cl.[2] ..... F26B 19/00; G08B 21/00

[58] Field of Search ..... 116/74, 67 R, 25, 60, 116/148, 149, 150; 34/45, 89; 46/191

[56] References Cited

UNITED STATES PATENTS

| | | | |
|---|---|---|---|
| 1,102,340 | 7/1914 | Kane | 116/25 |
| 1,318,638 | 10/1919 | Anthon et al. | 116/74 |
| 2,655,892 | 10/1953 | Manecke | 116/67 R |
| 2,802,441 | 8/1957 | Epstein et al. | 116/25 |
| 3,127,867 | 4/1964 | Bochan | 116/67 R |
| 3,236,008 | 2/1966 | Ryan | 46/191 |

*Primary Examiner*—Herbert Goldstein
*Assistant Examiner*—Daniel M. Yasich
*Attorney, Agent, or Firm*—Hill, Gross, Simpson, Van Santen, Steadman, Chiara & Simpson

[57] ABSTRACT

A signal device signals cycle changes in a dryer by sounding a bell assembly upon acceleration and/or deceleration of the motor shaft. When the rotational speed of the flywheel is synchronized with the rotational speed of the motor shaft there is no striking contact between the bell assembly and the clapper of the flywheel assembly. A one-way spring clutch is employed to limit signaling to either acceleration or deceleration of the motor shaft. The device also may be constructed in a reverse manner, with the bell acting as a flywheel journaled on the shaft and the clapper assembly rotatable with the motor shaft.

16 Claims, 4 Drawing Figures

Fig-1
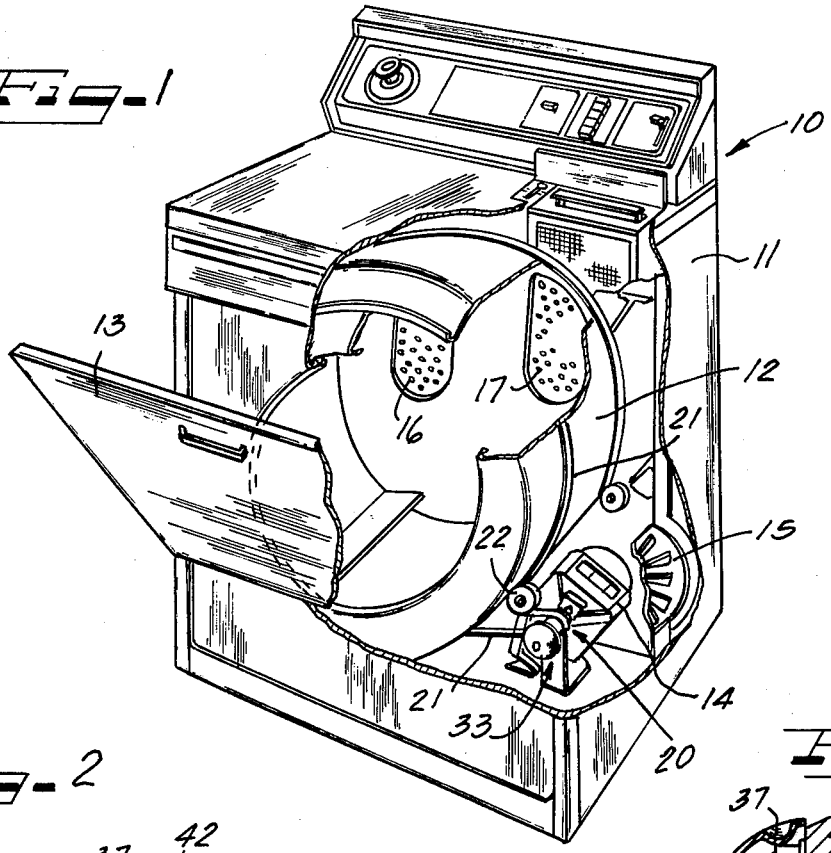
Fig-2
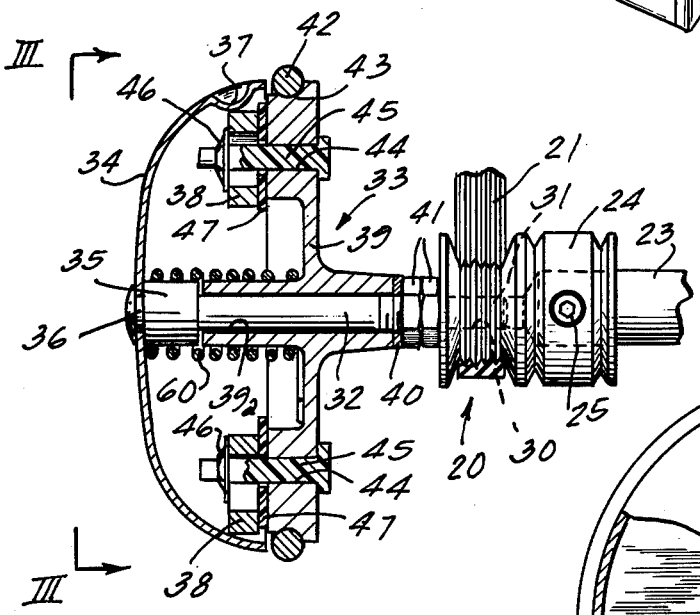
Fig-4
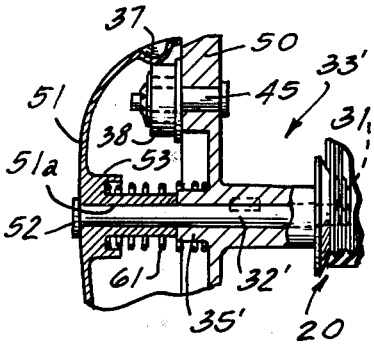
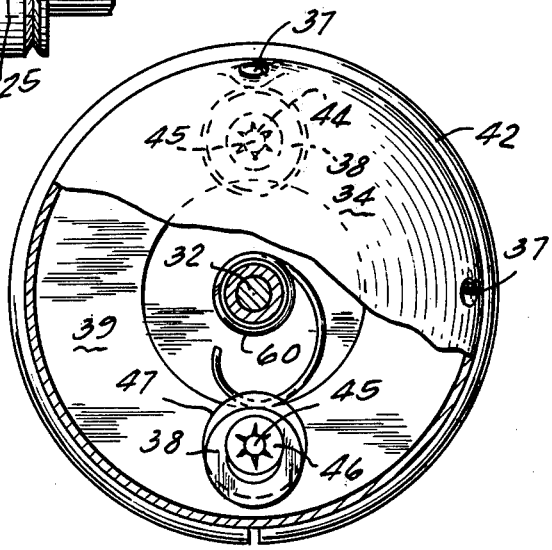
Fig-3

FLYWHEEL IMPELLED CYCLE SIGNAL FOR APPLIANCE

BACKGROUND OF THE INVENTION

1. Field of the Invention

This invention relates to improvements in home appliances and the like, and particularly to a device for audibly indicating selectively the beginning, the end, or both the beginning and the end of a cycle by automatically signaling the acceleration and/or deceleration of the drive mechanism of the appliance.

2. Description of the Prior Art

It is common in the automatic laundry dryer art to provide an audible signal to indicate to the operator that a drying cycle is completed. U.S. Pat. Nos. 3,277,859; 3,230,921; and 2,655,892 show various devices for bringing a clapper and a bell into contact with one another, including, respectively, a screw thread on the motor shaft, a tuned wire oscillated by a cam, and a counter-weighted, spring-biased arm. U.S. Pat. No. 3,127,867 shows a bell journaled coaxially on a dryer motor shaft by means of low-friction bearings therebetween adjacent a centrifugally-actuated clapper mechanism rotatable with the motor shaft. When the motor shaft ceases rotating, the clapper is moved by a spring into a position to impact a striker of the bell as the bell continues rotating by inertia or flywheel action. In response to motor shaft rotation the clapper is moved inwardly by the force of a counterweight, preventing sounding of the bell despite relative rotation between the clapper and the bell.

SUMMARY OF THE INVENTION

In a clothes dryer, a signal means comprises a bell affixed to the drive shaft of the motor which drives the dryer drum. The bell covers the outer part of the signal means and includes at least one radially inwardly-extending protuberance. A flywheel and clapper assembly is journaled on a shaft connecting the bell and the motor shaft and includes a plurality of clapper lugs loosely mounted on pins such that upon relative rotation between the bell and the flywheel assembly the clappers will impact the protuberance on the bell to make the bell sound. It is also possible to reverse the parts, mounting the clappers to rotate with the dryer motor shaft and journaling a weighted bell about the shaft for rotation relative thereto. In either form of the invention, a simple one-way spring clutch may be employed between the flywheel and the drive shaft to eliminate the bell signal on either the initiation or termination of drive shaft rotation, as may be desired. Absent this spring clutch the signal means will effectively provide an audible signal in response to any appreciable change in the rotational speed of the drive shaft.

Thus, when the motor shaft begins to turn the rotational speed of the flywheel and clapper assembly lags that of the motor shaft and a bell sound emanates from impacts between the bell and the clappers. After the motor shaft reaches its constant drive speed, the inertia of the flywheel assembly will gradually be overcome and the assembly will become rotationally synchronized with the bell to terminate the bell sound. Upon deceleration of the motor shaft, the flywheel assemly will decelerate more slowly than the more massive dryer drum, belt, and drive shaft; and a bell signal will be once again produced. Addition of a spring clutch may synchronize acceleration of the flywheel with the motor shaft and bell while allowing non-synchronous deceleration. The signal device also includes generally smooth symmetrical external surfaces substantially enclosing said device which smooth surfaces are therefore not subject to striking or snagging items adjacent thereto or coming into contact therewith on rotation of the rotatable portions of the device.

BRIEF DESCRIPTION OF THE DRAWINGS

FIG. 1 is a general view of an automatic clothes dryer partially cut away to show internal features of the dryer including placement of the device of the present invention.

FIG. 2 is a longitudinal cross-sectional view of a bell and a flywheel of the present invention mounted on the motor shaft adjacent the drive pulley.

FIG. 3 is an elevational view along line III—III of FIG. 2, partially cut-away to show the spring clutch and clapper lugs of the flywheel assembly.

FIG. 4 is a longitudinal cross-sectional view of an alternate embodiment of the invention.

DESCRIPTION OF THE PREFERRED EMBODIMENTS

An automatic clothes dryer of the rotating drum type is shown generally at 10 in FIG. 1, with parts of the cabinet 11 cut away to show a rotatable drum 12 accessible through a door 13. A motor 14 is mounted within the cabinet 11 and drives a blower 15 mounted at one end thereof to draw temperature-conditioned, i.e. heated, air from a duct 16, through the interior of the drum 12 and out through an exhaust duct 17. The opposite end of the motor 14 drives a pulley 20 which drives a belt 21 engaging the exterior surface of the drum 12. The belt 21 is tensioned by an idler pulley 22 arranged between the drum 12 and the drive pulley 20, and the drum 12 is driven through frictional contact with the driven belt 21.

As shown in FIG. 2, it is convenient to mount the pulley 20 to a driven shaft 23 of the motor 14 by means of a collar 24 formed integrally with and at one side of the pulley 20 which accepts the motor shaft 23 therein. A locking screw 25 is received within the wall of the collar 24 and may be adjusted radially inwardly to engage frictionally the surface of the shaft 23, prividing a non-rotatable connection between the shaft 23 and the pulley 20 under normal circumstances.

In accordance with the principles of the present invention, the pulley 20 is conveniently formed with fastening means such as an internally threaded bore 30 indicated in broken lines in FIG. 2 opposite the collar 24. This internal thread 30 receives a cooperatively threaded end portion 31 of a shaft 32 of a signal means 33 of the present invention. The shaft 32 is held by the cooperation of the threaded portion 31 and the threaded bore 30 to rotate coaxially with the output shaft 23 of the motor 14. Although the signal means is shown affixed to the pulley 20, it could equally well be affixed to and coaxially with any of the other driven means such as blower 15 or idler pully 22 or even drum 12.

In the first embodiment of the signal means as shown in FIG. 2, an audible signal device or bell 34 is affixed irrotatably to an enlarged collar portion 35 of the shaft 32 by any convenient means such as a rivet 36. The bell 34 may be shaped in any suitable way and have properties which give a pleasant audible signal when sounded.

The periphery of the bell 34 is provided with a radially inwardly-extending protuberance or striker 37 engageable by a clapper means 38.

A flywheel 39 is journaled on the shaft 32 between the collar 35 and a washer 40 spaced therefrom by cooperating lock nuts 41,41 on the threaded shaft 31. The flywheel 39 may be of any convenient material such as plastic or nylon, with its bearing bore 39*a* and the shaft 32 lubricated if necessary to provide an appropriate low-friction, low cost bearing. The flywheel 39 has a lock-ring weight 42 snaplocked into a peripheral recess 43 formed in the flywheel to provide appropriate mass for the flywheel. Spaced inwardly from the periphery of the flywheel 39 and symmetrically about the axis thereof are at least two apertures 44 each of which receives in firm, press-fitted engagement a corresponding pin 45. A lug or clapper 38 is received loosely on each of the pins 45 adjacent the bell 34 and each clapper 38 has sufficient overall diameter to contact the striker or protuberance 37 of the bell 34 when moved to a radially-outwardly or striking position by gravitational and/or centrifugal forces. Each lug 38 is retained axially on its pin 45 by a locking washer 46 near the free end thereof. A plastic or metal bushing 47 is provided between each lug 38 and the adjacent surface of the flywheel 39 to insure free movement of the lug 38 in response to gravitational and/or centrifugal forces.

In the signal device of the present invention the bell 34 also acts as a cover over the face of the flywheel carrying the clappers 38, the pins 45, the lock washers 46, and the bushings 47. The cover prevents foreign matter such as dirt and lint from collecting on or in the signal device and interfering with its operation, and also provides a safety feature inasmuch as the rotating signal device will present only a generally smooth surface not likely to catch or damage items adjacent thereto. This safety feature thus facilitates servicing of the dryer.

In an alternative embodiment of the invention signal means 33' is shown in FIG. 4, with the pulley 20 received in the same manner as in FIG. 2 on the motor shaft 23 (not shown) and the signal means 33' attached to the pulley at a threaded portion 31 of a shaft 32'. A clapper assembly 50 is affixed or keyed to the shaft 32' to rotate with that shaft 32' and the shaft 23 of the motor 14. The assembly 50 carries pins 45 each fitted with a clapper or lug 38 in the same manner as shown in FIG. 2. An audible signal device in the form of a bell 51 is journaled on the shaft 32' inwardly of a retention collar 52 on the end of the shaft 32'. The bell 51 may be weighted in any convenient manner, as at 53 outwardly of its bearing surface 51*a* on the shaft 32' to provide appropriate flywheel mass to insure sufficient inertia and pleasant audible tone to the bell 51 when it is struck by clappers 38.

Also in accordance with the principles of the present invention, either of the illustrated embodiments of the device may be provided with one-way spring clutch means as shown at 60 in FIG. 2 and 61 in FIg. 4. The diameter of the spring 60 or 61 is such as to snugly engage the enlarged portion 35 of the shart 32 or a central collar portion 35' of the clapper assembly 50, respectively, and to more loosely engage the outer surface of the flywheel 39, 51 radially adjacent the bearing surface 39*a*, 51*a* thereof or a recess in the weighted portion 53 of the audible signal device 51 radially outwardly of and adjacent the bearing surface 51*a*, respectively. Depending on the direction of winding of the coil of the spring 60, the parts 34 and 39 will be permitted to rotate in only one direction with respect to one another, the coil 60 wrapping firmly about the two parts if relative rotation in the opposite direction is attempted as is well known. This one-way spring clutch arrangement works similarly in the alternative embodiment illustrated in FIG. 4 with the spring 61 preventing relative rotation in one direction between the assembly 50 and part 51. Thus, an appropriate spring may be selected to allow relative rotation of the flywheel 39 with respect to the bell 34 or of the clapper device 50 with respect to the bell 51 in one direction only so that an audible signal will be produced upon either start-up or stopping of a cycle of the appliance but not on both occasions. Of course, if no one-way spring clutch is provided the signal device will produce an audible signal upon both acceleration and decelaration of the drive means or motor and thereby announce both the beginning and the end of the cycle.

In operation, a signal means device 33 or 33' may be affixed to the end of the motor shaft 23 by means of the threaded receptacle 30 in the pulley 20 as an accessory, either at the factory or by a dealer or installer. The shaft 32 or 32' is merely threaded tightly into the bore 30 in the pulley 20 to prevent loosening thereof and to assure corotation of the bell 34 or the clapper assembly 50 therewith.

Upon start-up of the motor 14 during a drying cycle, the motor 14 will rotate the shaft 32 and the bell 34 of the first embodiment. Because of the inertia of the flywheel 39 including the weight 42 and the low-friction connection between the shaft 32 and the bearing surface 39*a*, the rotational speed of the flywheel 39 will lag behind the rotational speed of the bell 34 in the absence of interference from the oneway spring clutch 60. As a result of this relative or nonsynchronous rotation the lugs 38 will strike the protuberances 37 upon each complete rotation of the bell 34 with respect to the flywheel 39. In this regard it may be noted that the lugs 38 will be positioned radially outwardly on the pins 45 in response to both gravitational and centrifugal forces, but that due to the relative sizing of the internal diameter of each lug 38 to its pin 45, and the outer diameter of the lug 38, the lug may strike the protuberance 37 any time that the pin 45 is located outside an arc, for example, within about 45° of the vertical.

Thus, until the flywheel 39 begins rotating with speed sufficient to throw the lugs 38 to their radially outer limit, it is possible that only one lug will strike each protuberance 37 upon each complete rotation of one part with respect to the other. However, this will not seriously affect the siganl produced, since during its cycle the motor 14 will be rotating at over 1500 rpm, producing at least 3000 impacts per minute if two protuberances 37,37 are provided, as shown in FIG. 3. As the flywheel 39 gains rotational speed due to frictional contact between the bearing 39*a* and the shaft 32 as well as the effects of the impacts between the protuberances 37 and the lugs 38, the number of impacts per minute will decrease until the inertia of the flywheel has been completely overcome and there is no longer any relative rotation between the bell 34 and the flywheel 39.

Since the drum 12 is rotated essentially at constant speed by the motor 14 during the cycle, there will be no signaling during the cycle since there are no substantial forces to upset the relations between the parts.

If a clockwise-coiled spring 60 were added to the device 33 as shown in FIG. 2, and the motor shaft 23 rotated in a counter-clockwise direction, the flywheel 39 would be accelerated substantially at the same rate as the shaft 32, resulting in synchronous rotation of the parts (no relative rotation between the parts) and hence no audible signaling of the cycle start-up.

Upon completion of the cycle, the motor 14 will shut off and the shaft 23 will stop rotating under the friction load of the drum supports and of clothing within the drum 12. However, the rotational momentum of the flywheel will cause the flywheel to continue to rotate on its bearing 39*a* on the shaft 32, with the lugs 38 striking the inwardly-extending protuberances 37 upon each complete relative rotation, sounding the bell 34 to signal the end of the cycle, until the inertia of the flywheel is overcome by friction in the bearing 39*a* and the effects of the lugs 38 striking the protuberances 37. A spring 60 wound in the clockwise direction will not interfere with the relative rotation in this direction.

In similar manner, the device 33' of FIG. 4 will sound an audible signal only upon starting and/or stopping of rotation of the motor shaft 23, except that the bell 51 will lag behind changes in rotational speed of the shaft 23 rather than the flywheel and clapper assembly 39 as in FIG. 2. Again, provision of a coil spring clutch 61 will allow relative rotation selectively either upon cycle start or cycle stop.

Thus, the signal means according to the present invention may be utilized to audibly indicate the beginning, the end, or both the beginning and the end of a dryer cycle depending on whether a spring clutch (with either clockwise or counterclockwise wound coils) is included. Also, the signal means may be utilized to indicate audibly any change in the speed of the drive means or one or more of the driven components of the dryer during the cycle. Such a speed variation may be symptomatic of a dryer malfunction, and would be indicated by the siganl means provided the signal means were mounted on an appropriate machine component.

Although various modifications might be suggested by those versed in the art, it should be understood that I wish to embody within the scope of the patent warranted hereon all such modifications as reasonably and properly come within the scope of my contribution to the art.

The embodiments of the invention in which an exclusive property or privilege is claimed are defined as follows:

1. In a laundry appliance having drive means for rotatably driving components of the appliance during an operative cycle, signal means responsive to a change in rotational speed of said components for audibly indicating a change in speed, said signal means comprising:

a shaft connected to and coaxial with and rotatable with said drive means;

a flywheel journaled on said shaft for synchronous and non-synchronous rotation therewith, said non-synchronous rotation being produced by a change in the speed of the drive means and lasting until the inertia of said flywheel is overcome by friction in the flywheel journaling; and bell means and clapper means, one of which is carried by said flywheel and the other carried in contactable relation thereto by said shaft, for providing an audible signal upon substantially all non-synchronous rotation of the flywheel on said shaft.

2. Signal means as defined in claim 1, the clapper means comprising a plurality of lugs carried radially outwardly of the axis of rotation of the flywheel and shaft, spaced circumferentially apart from one another, and each of said lugs forming a central aperture having a diameter and retained by and free to oscillate radially on an axially-extending pin having a diameter smaller than the diameter of said aperture of said lug mounted thereon in response to gravitational and centrifugal forces thereon, at least one of said lugs being in position at any given time to provide said audible signal upon non-synchronous rotation of the flywheel on said shaft.

3. Signal means as defined in claim 2, the lugs being two in number and carried radially opposed from one another.

4. Signal means as defined in claim 2, the lugs being carried by the flywheel and the bell means being carried by the flywheel shaft.

5. Signal means as defined in claim 2 the lugs being carried by the flywheel shaft and the bell means being carried by the flywheel.

6. In a laundry appliance having drive means for rotatably driving components of the appliance during an operative cycle, signal means responsive to a change in rotational speed of said components for audibly indicating a change in speed, said signal means comprising:

a shaft connected to and coaxial with and rotatable with said drive means;

a flywheel journaled on said shaft for synchronous and non-synchronous rotation therewith, said non-synchronous rotation being produced by a change in the speed of the drive means and lasting until the inertia of said flywheel is overcome by friction in the flywheel journaling;

bell means and clapper means, one of which is carried by said flywheel and the other carried in contactable relation thereto by said shaft, for providing an audible signal upon substantially all non-synchronous rotation of the flywheel on said shaft;

a coaxial cylindrical portion on each of said shaft and said flywheel; and one-way spring clutch means extending between and having opposite ends overlying said cylindrical portions of the flywheel and the shaft for engaging therebetween and accelerating the flywheel substantially synchronously with the shaft but allowing non-synchronous rotation upon deceleration of the flywheel and shaft.

7. In a laundry appliance having drive means for rotatably driving components of the appliance during an operative cycle, signal means responsive to a change in rotational speed of said components for audibly indicating a change in speed, said signal means comprising:

a shaft connected to and coaxial with and rotatable with said drive means;

a flywheel journaled on said shaft for synchronous and non-synchronous rotation therewith, said non-synchronous rotation being produced by a change in the speed of the drive means and lasting until the inertia of said flywheel is overcome by friction in the flywheel journaling;

bell means and clapper means, one of which is carried by said flywheel and the other carried in contactable relation thereto by said shaft, for providing an audible signal upon substantially all non-synchronous rotation of the flywheel on said shaft;

a coaxial cylindrical portion of said shaft and said flywheel; and one-way spring clutch means extending between and having opposite ends overlying said cylindrical portions of the flywheel and the shaft for engaging therebetween and decelerating the flywheel substantially synchronously with the shaft but allowing non-synchronous rotation during acceleration of the flywheel and shaft.

8. In a laundry appliance having drive means for rotatably driving components of the appliance during an operative cycle, signal means responsive to any substantial change in the speed of the drive means for audibly indicating a cycle change, said signal means comprising:

a shaft rotated by and connected to and coaxial with said drive means;

an audible signal device fixed to said shaft for rotation therewith; and a flywheel journaled on said shaft adjacent said audible signal device, said flywheel including clapper means for striking said audible signal device during rotation of said flywheel with respect to said shaft and producing an audible signal.

9. In an appliance having drive means for rotatably driving components of the appliance, the improvement comprising signal means responsive to any substantial change in the rotational speed of the drive means having a shaft for audibly indicating change in speed, said signal means comprising:

an audible signal device fixed to another shaft connected to the shaft of said drive means for rotation therewith and a flywheel journaled on said other shaft adjacent said audible signal device for synchronous and non-synchronous rotation therewith, said non-synchronous rotation of said flywheel occurring substantially during periods of acceleration and deceleration of said shaft of said drive means and said synchronous rotation occurring substantially during periods of constant-speed rotation of said drive means shaft, and said flywheel including clapper means for striking said audible signal device during substantially all non-synchronous rotation thereof, to produce an audible signal.

10. In an appliance as claimed in claim 9, said audible signal device comprising a bell, said bell and said flywheel means each having radially-outward peripheries in closely spaced relationship to one another to substantially enclose said clapper means and a radially-inward side portion of said flywheel means, whereby foreign matter is substantially prevented by said bell and flywheel from interfering with operation of said signal means.

11. In an appliance as claimed in claim 9, said audible signal device comprising a bell including a substantially smooth, axially symmetrical exposed outer surface, said bell covering said clapper means and a portion of said flywheel means, said portion of said flywheel not covered by said bell being substantially smooth and symmetrical about its axis, whereby operation of the signal means is not subject to snagging of items adjacent thereto.

12. A laundry machine having drive means including a shaft for rotatably driving machine components during an operative machine cycle and characterized by constant-speed rotation of said shaft during said cycle and by acceleration and deceleration of said shaft at the initiation and termination respectively of said cycle, said laundry machine including signal means responsive to said acceleration and deceleration of said shaft to audibly indicate the beginning and end of said cycle, said signal means comprising:

a second shaft connected to said drive means shaft, an audible signal device fixed to said second shaft for rotation therewith, and a flywheel journaled on said second shaft adjacent said audible signal device for generally synchronous rotation therewith during constant-speed rotation of said drive means shaft and generally non-synchronous rotation therewith during acceleration and deceleration of said drive means shaft, said flywheel including clapper means for striking said audible signal device during said non-synchronous rotation to produce an audible signal.

13. In a laundry appliance having a motor including a drive pulley carried on an output shaft thereof, a rotatable drum for tumbling clothes during a drying cycle, and a drive belt drivingly interconnecting said drive pulley and said drum, signal means mounted on said pulley and responsive to at least one of accelerating and decelerating conditions of said motor for providing an audible signal upon and after said condition occurs, said signal means comprising:

an audible signal device including a bell portion having at least one radially-inwardly-extending protuberance, a shaft having a first and affixed to said drive pulley, and a flywheel journaled on said drive pulley shaft for synchronous and non-synchronous rotation said output shaft, said flywheel including at least two clapper lugs attached to outer portions of said flywheel adjacent said bell portion for limited radial movement with respect thereto, and at least one of said lugs striking said protuberance of said bell portion during non-synchronous rotation of said flywheel with respect to said audible signal device to produce an audible signal.

14. In a laundry appliance having a motor including a drive pulley carried on an output shaft thereof, a rotatable drum for tumbling clothes during a drying cycle, and a drive belt drivingly interconnecting said drive pulley and said drum, signal means mounted on said pulley, said signal means comprising:

an audible signal device including a bell portion having at least one radially-inwardly-extending protuberance;

a flywheel shaft having a first end affixed to said drive pulley;

a flywheel journaled on said flywheel shaft for synchronous and non-synchronous rotation therewith, said flywheel including at least two clapper lugs attached to outer portions of said flywheel adjacent said bell portion for limited radial movement with respect thereto, and at least one of said lugs striking said protuberance of said bell portion during non-synchronous rotation of said flywheel with respect to said audible signal device to produce an audible signal; and one-way clutch means between the flywheel and the audible signal device for permitting non-synchronous rotation therebetween during and after said decelerating condition of said motor and for preventing non-synchronous rotation therebetween during and after accelerating conditions of said motor.

15. In a laundry appliance having a motor including a drive pulley carried on an output shaft thereof, a rotatable drum for tumbling clothes during a drying cycle, and a drive belt drivingly interconnecting said drive pulley and said drum, signal means mounted on said pulley, said signal means comprising:

an audible signal device including a bell portion having at least one radially-inwardly-extending protuberance;

a second shaft having a first end affixed to said drive pulley;

a flywheel journaled on said second shaft for synchronous and non-synchronous rotation therewith, said flywheel including at least two clapper lugs attached to outer portions of said flywheel adjacent said bell portion for limited radial movement with respect thereto, and at least one of said lugs striking said protuberance of said bell portion during non-synchronous rotation of said flywheel with respect to said audible signal device to produce an audible signal; and one-way clutch means between the flywheel and the audible signal device for permitting non-synchronous rotation therebetween during and after said accelerating condition of said motor and for preventing non-synchronous rotation therebetween during and after said decelerating condition of said motor.

16. In an appliance having drive means for rotatably driving components of the appliance, signal means for audibly indicating a deceleration of said drive means; said signal means comprising:

flywleel means carried by a shaft threadedly connected to said drive means for synchronous and non-synchronous rotation with the drive means, said non-synchronous rotation being caused by acceleration or deceleration of said drive means;

one-way clutch means for preventing non-synchronous rotation caused by acceleration of said drive means;

bell means for producing an audible signal in response to striking contact with a portion thereof; and clapper means for striking said bell means in response to said non-synchronous rotation caused by said deceleration of said drive means.

* * * * *